US005801627A

United States Patent [19]

Hartung

[11] Patent Number: 5,801,627

[45] Date of Patent: Sep. 1, 1998

[54] PORTABLE LOSS-PROTECTION DEVICE

[76] Inventor: Dudley B. Hartung, 32 Clifton St., Somerville, Mass. 02144

[21] Appl. No.: 411,440

[22] Filed: Mar. 27, 1995

[51] Int. Cl.[6] ..... G08B 13/14

[52] U.S. Cl. ..... 340/568; 340/572

[58] Field of Search ..... 340/568, 571, 340/572, 573, 539

[56] References Cited

U.S. PATENT DOCUMENTS

| | | | |
|---|---|---|---|
| 4,899,135 | 2/1990 | Ghahariiran | 340/573 |
| 4,973,944 | 11/1990 | Maletta | 340/568 |
| 5,086,290 | 2/1992 | Murray et al. | 340/539 |
| 5,396,218 | 3/1995 | Olah | 340/572 |
| 5,402,104 | 3/1995 | LaRosa | 340/539 |

FOREIGN PATENT DOCUMENTS

| | | | |
|---|---|---|---|
| 2482338 | 11/1981 | France | 340/568 |
| 3215942 | 11/1983 | Germany | 340/568 |
| 2071956 | 9/1981 | United Kingdom | 340/568 |
| 2214340 | 8/1989 | United Kingdom | 340/568 |

*Primary Examiner*—Thomas Mullen

[57] ABSTRACT

An electronic device consisting of a Transmit Unit 11 and a Receiver-Alarm Unit 60 for the protection of portable electronic or other equipment from theft or inadvertent loss. The Transmit Unit 11 transmits a signal which is turned on or off according to the state of On-Select Switches 14 and Off-Select Switches 16. After a predetermined time from Pulse-Counter Timer 12 the signal may also be turned off. The Receiver-Alarm Unit 60 receives with Receiver 62 the transmission. Decoder 64 determines if the signal is being turned on or off. If it is turned on the Threshold Detector 66 monitors the incoming signal and when it falls below a threshold causes an alarm to be given.

9 Claims, 3 Drawing Sheets

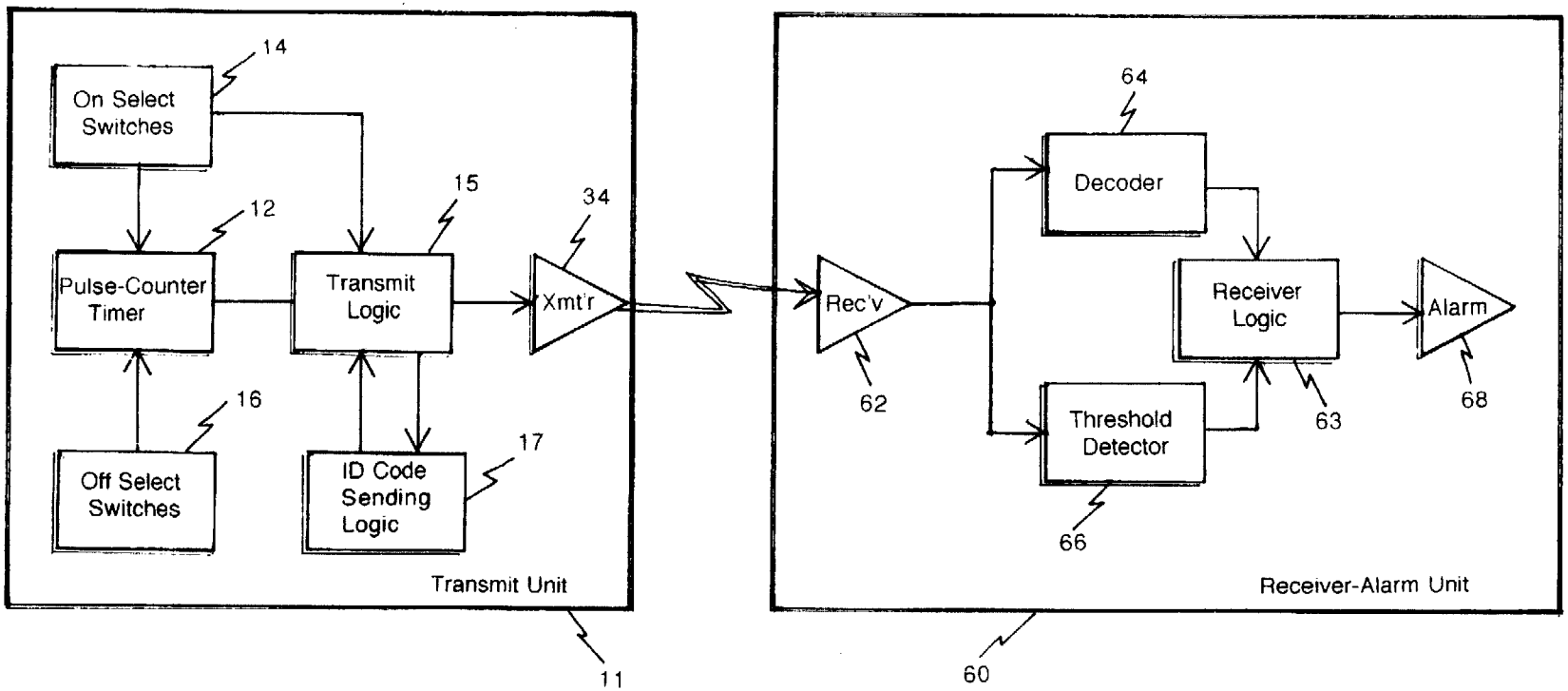
Fig.1 Block Diagram of Loss Protection Device

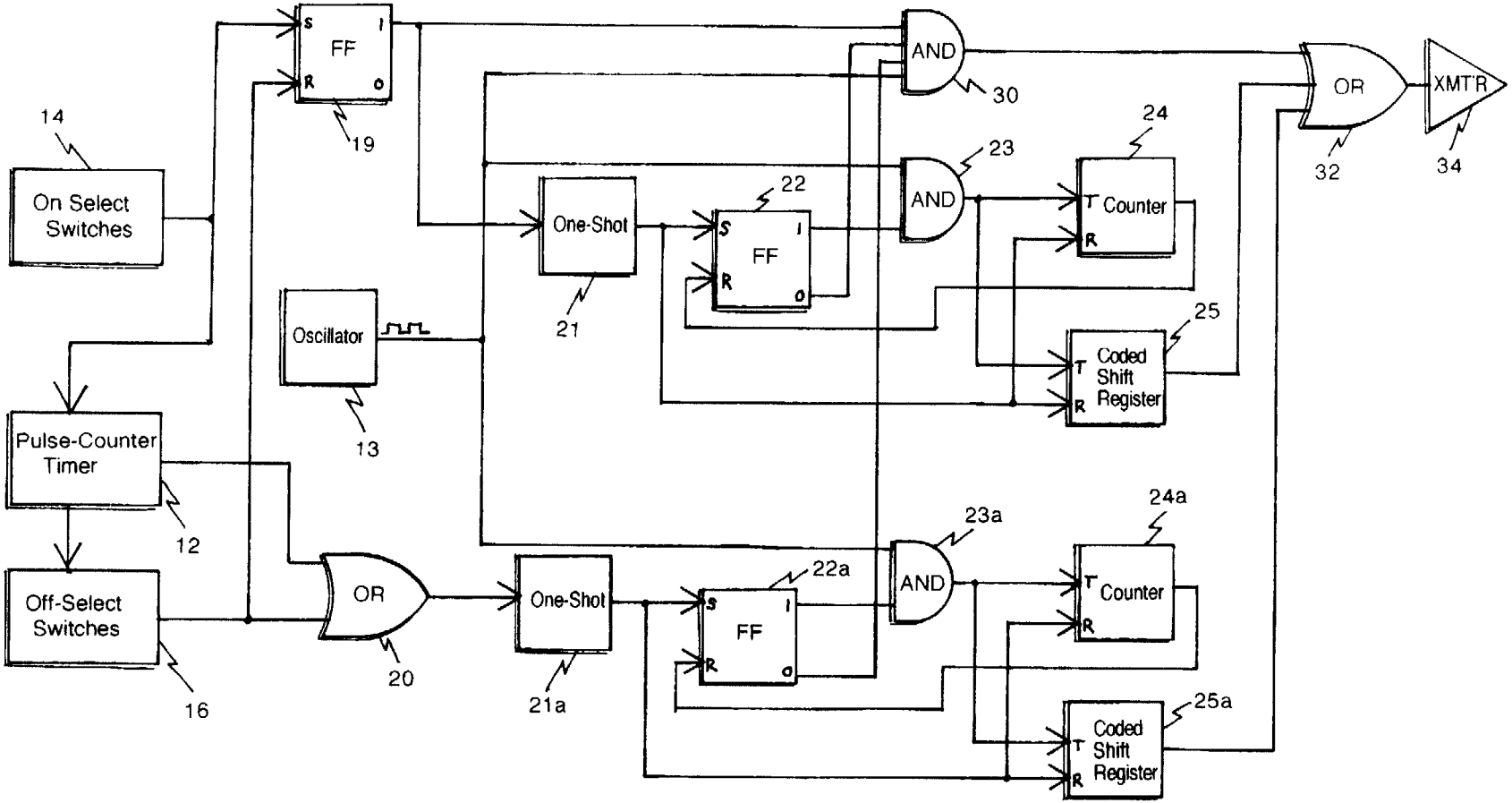
Fig.2 Transmit Unit

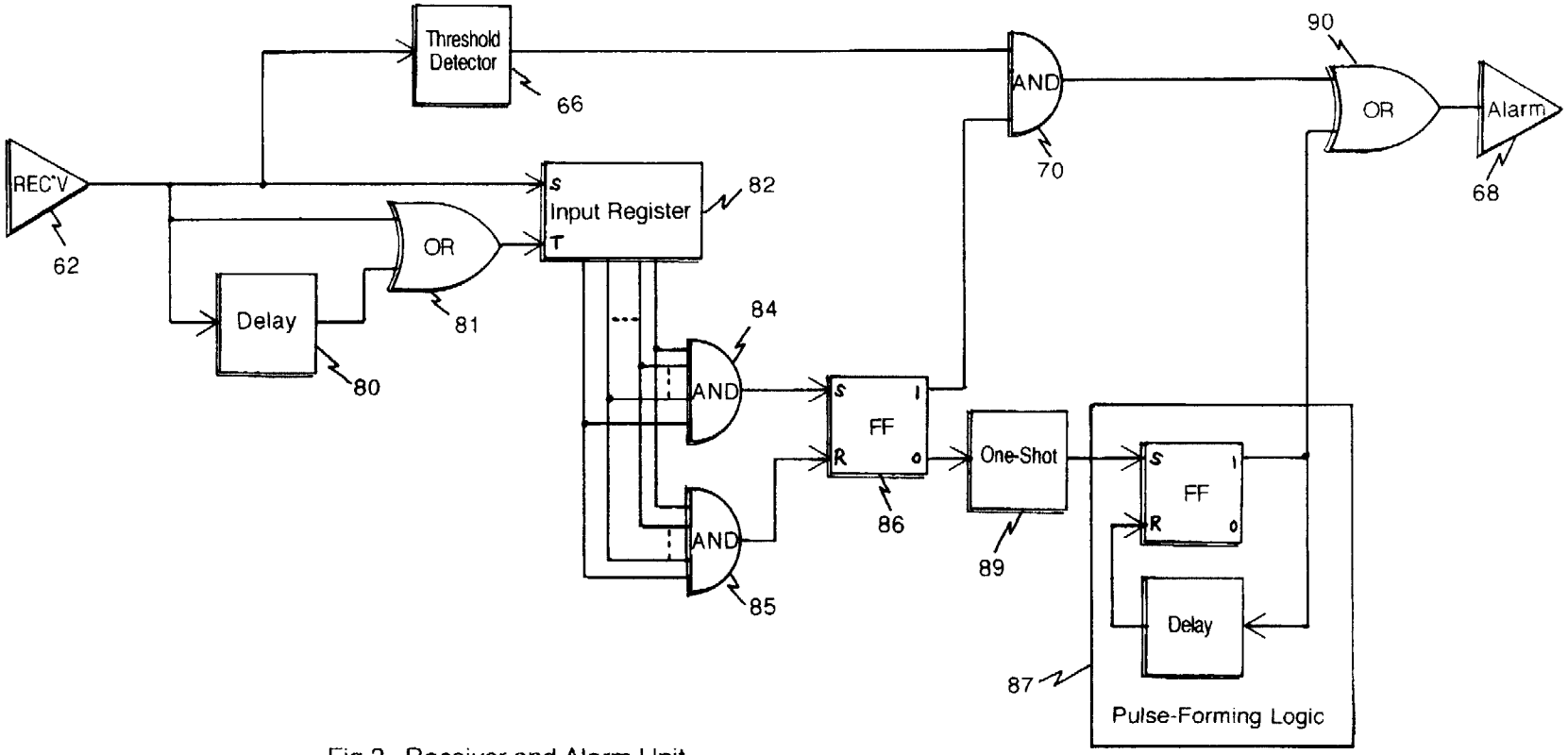
Fig.3 Receiver and Alarm Unit

PORTABLE LOSS-PROTECTION DEVICE

BACKGROUND-FIELD OF INVENTION

This invention is a Loss Protection Device comprised of a sending unit and a receiving unit to alert the user that a protected item has been either forgotten or stolen.

BACKGROUND-DESCRIPTION OF PRIOR ART

Owners of small portable electronic equipment such as lap-top computers often lose them by either forgetting them in the coffee shop or having them snatched by a thief. A suitable protection system requires two units, one at the device to be protected and one in proximity to the user. There are a number of such alarm systems in the art consisting of a sending unit and a receiving unit. Many of these utilize electrical threshold measuring of a received signal to indicate that one unit is over a certain distance from the other.

These systems are typically designed either to monitor people, such as nursing-home residents or children, or objects, such as briefcases. In the case of objects the usual purpose is to deter theft.

Typical systems include two patents by Narcisse, U.S. Pat. Nos. 4,593,273 and 4,675,656 for nursing home use. A base unit sends a signal and one or more mobile units return a message to the base unit indicating that the mobile unit is out of range. The base unit then sounds an alarm for the nurse. The mobile unit may also sound an alarm. Ghahariian U.S. Pat. No. 4,899,135 has a similar system for child monitoring, with the unit carried by the child sending a signal and the parent unit detecting "out of range" and giving an alarm for the parent.

Rosenthal and Murphy, U.S. Pat. No. 5,223,815 is a typical brief-case protection system. This has a transmitting unit that the owner carries and a receiving unit in the protected object. The receiving unit detects when it is out-of-range of the transmitting unit and gives a loud alarm which in this case includes a speech synthesized message. No alarm is given at the owner's location.

The problem with these and other present approaches is that they do not address the particular requirements of protecting portable electronic and computer equipment. First of all, a major problem is forgetting the equipmentleaving the lap-top computer in the coffee shop. Systems that give loud or otherwise effective anti-burglar alarms at the protected device are not suitable. The alarm has to be given to the user by the user-carried device. Secondly, the monitoring systems run continuously unless manually shut down. It is not necessary to run an alarm system when the device to be protected is in active, user-monitored use. In fact it is undesirable because the device being protected may be sending operating criteria and may even supply much or all of the logic to the alarm system on a time-shared, programmed basis. In this situation, the alarm system would unnecessarily utilize computer capacity and battery time. Finally, to conserve power, it is desirable to shut down the alarm system after a period of time of inactivity.

Even in the nursing home situation it is desirable to shut the system down to conserve power when the person being monitored is not moving.

Many systems do not have a device identification method to determine that the particular device being protected is out of range and not some other device being protected by a similar system.

OBJECTS AND ADVANTAGES

The invention is a Loss Protection Device which provides the basic protection or warning to an operator when a Receiving and Alarm Unit is an unacceptable distance away from a separate Transmit Unit. The Transmit Unit sends distance-determining signals which the Receiving Unit receives and processes. There are some unique and desirable features in this invention, however.

First of all, the Device of the invention continuously and automatically turns on and off the transmission of distance determining signals. For instance, the Device turns off when the equipment it is protecting is in active use, implying the operator is right there. Conversely, when the protected equipment is turned off and quiescent, the equipment is vulnerable to theft or being forgotten and should be monitored.

Secondly, the Device shuts down if it has been in monitoring mode for a period of time, such as an hour. This implies that the protected equipment is in a semi- permanent place like at home or at the office and alarms are not wanted if the operator leaves. However, the Device beeps when it shuts down to warn the operator that the Device is not monitoring, giving the operator the option of reactivating the Device.

The Device can be reactivated after being shut down by movement of the protected equipment. This allows the operator to easily reactivate the Device. The Device is similarly activated when it is picked up by a thief.

This flexibility of automatic turn on and turn off thereby protects the equipment all the time from being stolen. The equipment is also protected for an optimum period of time to best protect the equipment from being forgotten while minimizing nuisance alarms. Shut down while not being used is very important with portable, battery run equipment, particularly the Transmit Unit which has a transmitter, to conserve power.

Another advantage is that modern computer-type equipment often use the same electronics through program control to perform various functions, such as data processing, and operate various equipments, such as printers, simultaneously. This Device might also be partly contained in such a system. It is therefore desirable not to require continual computer output to the Device while it is not needed.

A unique device identifying code is sent at the start and stop of transmissions between the Transmit Unit and Receiver-Alarm Unit of the Device. It can be expected that more than one protected item is in the same area and shut-down or start-up of one person's device should not affect another.

The invention is not dependent on type of transmission between units. Ultrasonic transmission would be desirable in many applications, but radio frequency or infrared could equally well be employed.

The Device is also applicable to monitor people. In a nursing home situation the Transmitter unit can be carried by the patient. When the patient is moving, the distance is monitored. However, when the patient stops and sits or lies down, the system shuts off, conserving power.

DESCRIPTION OF DRAWINGS

FIG. 1 is a Block Diagram of the Loss Protection Device. It shows the basic internal elements of the Transmit and the Receiver-Alarm Units.

FIG. 2 is an embodiment of the Transmit Unit, showing the logic necessary to accomplish the functions of the invention.

FIG. 3 is an embodiment of a Receiver and Alarm Unit to function with the Transmit Unit of FIG. 2.

DESCRIPTION AND OPERATION

FIG. 1 is a block diagram of the Loss Protection Device.

The Transmit Unit 11 is in or affixed to the object to be protected. The Receiver-Alarm 60 is in proximity of the monitoring person.

In the Transmit Unit 11 the On-Select Switches 14 and Off-Select Switches 16 monitor the condition of the object being protected. The On-Select Switches 14 are levels or pulses which indicate conditions where it is desired that the system should be activated. These could include, but are not limited to, movement sensing switches, power switches, or time-of-day (clock) signals. The Off-Select Switches 16 are levels or pulses which indicate conditions where the system should be de-activated. These include but are not limited to operating signals from the protected device indicating that the operator is present and using the system. The Transmit Logic 15 starts and stops a continuous signal or pulse train in accordance with the state of these Switches 14 and 16. The Pulse-Counter Timer 12 sends a signal a predetermined time after the last switch change from the On-Select Switches 14, causing the Transmit Logic 15 to stop the continuous signal or pulse train. The ID Code-Sending Logic 17 provides identifying "start" and "stop" codes to be sent at the beginning and end of each continuous signal or pulse train. The Transmitter 34 transmits the continuous signal or pulse train and the "start" and "stop" codes.

The Receiver-Alarm Unit 60 receives and processes the information transmitted by Transmit Unit 11. The Receiver 62 receives the signal or pulse train transmitted by Transmitter 62. The Decoder 64 reads and decodes the identifying "start" and "stop" codes. If a "start" code is identified, indicating that the system is active, the Threshold Detector 66 monitors the output signal from the Receiver 62. When the signal goes below a certain threshold level, indicating the Transmit Unit 11 and Receiver Alarm unit 60 are an unacceptable distance apart, the Threshold Detector 66 signals the Receiver Logic 63, which in turn triggers the Alarm 68. When a "Stop code" is detected, the Receiver Logic 63 inhibits alarms. The Receiver Logic 63 also sends a short signal to the Alarm 68 when the "stop" code has been detected, indicating to the user that the system is no longer active.

FIG. 2 shows an embodiment of the Transmit Unit 1 1 of FIG. 1.

The On-Select Switches 14 set or turn on Flip Flop 19, which in turn enables AND Gate 30. The On-Select Switches at the same time actuate Timer 12 to count pulses from Oscillator 13. While a count is in process, a new signal indicating a new on-condition from the On-Select Switch 14 resets the Pulse-Counter Timer 12 and starts a new time count. At a predetermined count, indicating a particular length of time dependent on Oscillator 13 frequency and counter size, the Counter 12 provides an Off select signal comparable to the Off-Select Switches 16. When the Off-Select Switches 16 or the Pulse-Counter Timer 12 indicate an "off" condition, Flip-Flop 19 is reset or turned off, shutting off the pulse train.

"Start codes" and "Stop codes" are transmitted at the start and stop of the continuous pulse train. The "start code" is preprogrammed in Coded Shift-Register 25. For logical ease in eventual decoding in the Receiver-Alarm 60, a code having no more than one zero in a row, for example, 1110101101, not 1001000111, is used. Minor logical changes would allow the use of any code. When Flip-Flop 19 is set by an On condition from On-Select Switches 14, the One-Shot 21 is activated to send a pulse. This pulse sets Flip-Flop 22, which in turn enables AND Gate 23 to send pulses from Oscillator 13 to trigger Counter 24 and Coded Shift-Register 25. Coded Shift-Register 25 is pre-wired with a distinctive "start code" and "device identifier". The Counter 24 overflows after the "start code" and "device identifier" are fully shifted out of the Coded Shift-Register and through OR Gate 32 to the Transmitter 34. The Counter 24 also resets Flip-Flop 22 to await the next "start code".

"Stop codes" with a "device identifier" are similarly sent. When the Off-Select Switches 16 or Pulse-Counter Timer 16 send a signal through OR Gate 20, One-Shot **21*a* starts the same sequence through Flip-Flop 22*a*, AND Gate 23*a*, Counter 24*a*, and Coded Shift-Register 25*a*. The difference is that Coded Shift-Register 25*a* is coded with a "stop code" and "device identifier". Also, Flip-Flop 19 is reset to inhibit the sending of the continuous signal from Oscillator 13. Also the continuous signal is inhibited during "start code" and "stop code" transmission by either Flip-Flop 22 or 22*a* disabling AND Gate 30**.

The transmitted pulses, consisting of either the Pulse Train or the Coded Identification Pulses, are received by the Receiver-Alarm shown in FIG. 3. The Receiver 62 receives the transmitted signal and provides pulses at a voltage proportional to the incoming signal strength to the Threshold Detector 66. If said voltage is less than a predetermined level, the Threshold Detector 66 provides a "Less Than" continuous signal.

Pulses from the Receiver 62 are shifted into the Input Register 82 by the pulses from Receiver 62 or by pulses delayed by one clock time by Delay 80. This delay fills in spaces in the input pulse stream caused by logical zeros. AND Gates 84 and 85 continuously monitor the parallel state of Input Register 82. AND Gate 84 is wired to recognize a "start code" with a "device identifier". When there is a "start code" AND Gate 84 sets Flip-Flop 86, which then enables the AND Gate 70 to allow an alarm indication when the Threshold Detector 66 indicates "out of range". AND Gate 85 is wired to recognize "stop codes" and "device identifiers". When the "stop code" is recognized by AND Gate 85, the Flip-Flop 86 is reset and inhibits AND Gate 70 and therefore prevents alarm signals.

When Flip-Flop 86 goes to "0" state, indicating "stop", or system deactivation, the One-Shot 89 sends a pulse to the Pulse-Forming Logic 87 to provide a signal for a momentary warning, a beep, to indicate to the user that the system has just turned "off".

Summary, Ramifications, and Scope

The reader will see that the invention is a very useful Loss Protection Device. The user is warned when separated from equipment being protected. This can happen when the equipment is stolen or forgotten. However, the invention minimizes inadvertent alarms and also minimizes power use.

The Loss Protection Device is activated or de-activated in accordance with on-select and off-select switches which may be internal or external to the device.

On-select switches could include switches indicating that the equipment being protected has been shut down, indicating that the user may not remain in close proximity to the equipment and that it should be monitored and protected. Also a movement sensing switch could signal that the equipment is picked up or moved and that the system should be on.

An off-select switch might be a switch activated by the protected equipment when the equipment is being operated by the user. If the equipment is being operated by the user, there is normally no need to protect it and the device can stop monitoring the equipment.

A timer in the device sends a shut-down signal a predetermined time after protective monitoring has started. If the protected equipment is inactive for a long period of time, it can usually be assumed that the equipment is in a protected environment and monitoring is stopped. However, the user is alerted by a signal when the device stops monitoring.

The Device consists of two units, one affixed to the equipment to be protected and one to be carried by the user. The equipment unit, which is the transmit unit, contains the logic to determine on and off conditions and transmits a continuous signal when on. The receive unit receives this signal, detects when the units are separated by a distance by level-detection of the incoming signal, and alarms the user. The transmit unit also sends a message indicating that the continuous signal is stopping and another message when the continuous signal is starting. Device identification is sent along with the start and stop messages to insure that the correct receive unit takes action. The receive unit decodes these messages and monitors or stops monitoring the incoming signal level as commanded. It also warns the user if the system is shutting down.

The description contains many details. These are not all necessary to the implementation of the invention. For example, many of the functions of the transmit unit could be accomplished in a programmable digital device. Also specific equipments to be protected might have specific and unique requirements for turn on and turn off.

Also the distance measuring method does not have to be a threshold monitoring method. Other methods such as Doppler or the use of two transmitters with the time between transmission and receipt indicating distance can be used.

The system of the invention can be used for people or animal monitoring systems. The alarm does not have to be a sound but could be a vibration or a shock.

The scope of the invention should therefore not be determined by the specific examples given but rather by the appended claims and their legal equivalents.

I claim:

1. A system with two units, the first for generating distance determining signals and the second for receiving these signals and determining that the two units are separated by a certain distance and then causing an action command signal where said distance determining signals are activated and deactivated according to predetermined criteria, the system including:

said first and second units;

a transmitter in said first unit to transmit a distance determining signal;

switching means in said first unit to turn on and turn off said distance determining signal;

encoding means in said first unit to send a coded message at the beginning and another coded message at the end of said distance determining signal;

a receiver in said second unit to receive transmissions from the first unit;

a decoder in said second unit to recognize the coded messages at the beginning and end of said transmission;

signal strength determination means in said second unit to ascertain when received transmission strength is below a predetermined level; and a controller in said second unit to trigger the action command signal when the decoder has recognized a coded beginning message and has not yet recognized a coded ending message and the signal strength determination is below the predetermined level.

2. A system as shown in claim 1 where the coded messages for beginning and ending messages include a particular device identification code.

3. A system as shown in claim 1 where beginning and ending messages are identical.

4. A system as shown in claim 1 where the beginning and ending messages are different.

5. A system as shown in claim 1 where predetermined criteria for activation or deactivation of the distance determination signal includes signals from sensors and switches.

6. A system as shown in claim 1 where predetermined criteria for activation of the distance determination signal includes electrical inputs from a device to which the first unit is attached.

7. A system as shown in claim 1 where a time measurer deactivates the distance determination signal at a predetermined time after a predetermined change-of-state, including start-up and shut-down, of a device to which the first unit is attached.

8. A system with two units, the first for generating distance determining signals and the second for receiving these signals and causing an action command signal when the units are separated by a predetermined distance, where the distance determining signals are activated and deactivated according to predetermined criteria, the system consisting of:

switching means in the first unit to turn on and turn off the generated distance determining signals;

a receiver in the second unit to receive transmissions from the first unit;

a distance determinator in the second unit to ascertain when the two units are over a certain distance apart; and a controller in the second unit to trigger an action signal when the distance determinator indicates the units are over a certain distance apart.

9. A system with two units which can communicate between each other so that one unit can determine a distance between itself and another unit and cause action command signals in accordance to the determined distance, with the communicating signals activated and deactivated according to predetermined criteria, the system consisting of:

first and second units;

a transmitter in the first unit and a receiver in the second unit to transmit and receive signals;

a switch in said first unit to turn on and turn off transmit signals in accordance to predetermined criteria;

a detector in said second unit to detect communicating signals;

a distance determinator in said second unit to ascertain when the two units are a certain distance apart; and a controller in said second unit to trigger action signals when the distance determinator indicates the units are a certain distance apart.

* * * * *